US005650097A

United States Patent [19]

Wysong et al.

[11] Patent Number: 5,650,097

[45] Date of Patent: Jul. 22, 1997

[54] CORROSION INHIBITOR COMPOSITION FOR STEEL

[75] Inventors: Ernest Byron Wysong, Hockessin, Del.; James Allan Wingrave, Chadds Ford, Pa.; Steven Arnold Dombchik; Edward Clarkin Squire, both of Wilmington, Del.

[73] Assignee: E. I. Du Pont de Nemours and Company, Wilmington, Del.

[21] Appl. No.: 540,099

[22] Filed: Oct. 6, 1995

Related U.S. Application Data

[63] Continuation of Ser. No. 258,113, Jun. 13, 1994, abandoned.

[51] Int. Cl.[6] ..... C23F 11/167

[52] U.S. Cl. ..... 252/392; 252/389.23; 252/396; 106/14.05; 106/14.41; 106/14.42; 106/14.43; 422/7; 508/436; 508/437

[58] Field of Search ..... 106/14.05, 14.41, 106/14.42, 14.43; 252/49.6, 389.23, 392, 396; 422/7

[56] References Cited

U.S. PATENT DOCUMENTS

| | | | |
|---|---|---|---|
| 2,336,448 | 12/1943 | Cox | 252/390 |
| 2,574,954 | 11/1951 | Bishop | 106/14.26 |
| 2,665,995 | 1/1954 | Bishop | 106/14.26 |
| 2,718,500 | 9/1955 | Rudel et al. | 252/46.6 |
| 2,728,643 | 12/1955 | Vaugh | 252/389.21 |
| 2,728,644 | 12/1955 | Vaugh | 252/389.21 |
| 2,728,645 | 12/1955 | Vaughn | 44/380 |
| 2,728,646 | 12/1955 | Vaughn | 44/380 |
| 2,728,647 | 12/1955 | Vaugh | 252/389.21 |
| 2,728,728 | 12/1955 | Vaughn | 252/389.21 |
| 2,769,737 | 11/1956 | Russel | 252/390 |
| 2,773,032 | 12/1956 | Cantrell | 252/32.5 |
| 2,824,068 | 2/1958 | Hollis et al. | 252/389.21 |
| 2,840,498 | 6/1958 | Logue et al. | 428/472.3 |
| 2,841,126 | 7/1958 | Cantrell | 123/1 A |
| 2,848,414 | 8/1958 | Chenicek | 252/322.5 |
| 2,857,333 | 10/1958 | Thompson | 252/389.1 |
| 2,857,334 | 10/1958 | Thompson | 252/389.21 |
| 2,863,746 | 12/1958 | Cantrell | 44/380 |
| 2,891,909 | 6/1959 | Huges | 252/390 |
| 2,934,500 | 4/1960 | Cantrell | 252/49.9 |
| 2,952,658 | 9/1960 | Pfeifer | 524/132 |
| 3,006,849 | 10/1961 | Plemich | 252/34.17 |
| 3,029,127 | 4/1962 | Pollitzer | 422/15 |
| 3,079,339 | 2/1963 | Cantrell | 252/321.5 |
| 3,140,260 | 7/1964 | Foster | 252/151 |
| 3,341,461 | 9/1967 | Larsen | 252/390 |
| 3,397,150 | 8/1968 | Burt | 252/390 |
| 3,453,254 | 7/1969 | Wasserman | 252/390 |
| 3,516,922 | 6/1970 | Anzilotti | 208/47 |
| 3,783,132 | 1/1974 | Herbert | 252/390 |
| 4,130,524 | 12/1978 | Boerwinkle et al. | 524/140 |
| 4,347,154 | 8/1982 | Simmons | 252/305 |
| 4,604,226 | 8/1986 | Bartlett | 252/390 |
| 4,898,687 | 2/1990 | Parker et al. | 252/389.61 |
| 5,080,686 | 1/1992 | Garrecht et al. | 44/351 |
| 5,080,687 | 1/1992 | Garrecht et al. | 44/351 |
| 5,298,178 | 3/1994 | O'Neil et al. | 252/49.3 |
| 5,358,652 | 10/1994 | Macpherson | 252/51.5 R |
| 5,372,748 | 12/1994 | Schapira et al. | 252/389.23 |

FOREIGN PATENT DOCUMENTS

| | | | |
|---|---|---|---|
| 0293820 | 12/1988 | European Pat. Off. | C10M 105/22 |
| 0340498 | 11/1989 | European Pat. Off. | C23F 11/10 |
| 159434 | 3/1983 | Germany | C10M 23/05 |
| 709733 | 6/1954 | United Kingdom . | |
| 2234194 | 1/1991 | United Kingdom | B05D 7/14 |
| WO94/01517 | 1/1994 | WIPO | C10M 137/04 |

OTHER PUBLICATIONS

Neftepererab. Neftekhim (Moscow), vol. 3, issued 1986, Bnatov, E.S. et al., "Effectiveness of Synthetic Detergents In Removing Lubricating Greases from Steel Surfaces", pp. 11–13. See Chem Ab. 104:209631 only.

*Primary Examiner*—Sharon Gibson
*Assistant Examiner*—Valerie Fee

[57] ABSTRACT

Steel anticorrosion and lubricity composition consisting essentially of (a) a surfactant; (b) at least one neutralized alkyl phosphate in a surfactant:phosphate weight ratio in the range between 10:1 to 1:10, said phosphate having the general formula:

$$(RO)_m—P—(O)—(OH)_n$$

wherein R is an alkyl group having 4 to 20 carbon atoms; m is 1 or 2, and n is 3m; and optionally (c) 5 to 40 weight percent, based on the combined weight of said surfactant and said phosphate, of at least one carboxylic acid which has both a hydrophilic and a hydrophobic portion.

20 Claims, No Drawings

CORROSION INHIBITOR COMPOSITION FOR STEEL

This is a continuation of application Ser. No. 08/258,113 filed Jun. 13, 1994, now abandoned.

FIELD OF THE INVENTION

The present invention relates to providing steel and zinc-treated steel mill products with protection against corrosion during fabrication, shipping and storage, as well as enhanced lubricity.

BACKGROUND OF THE INVENTION

Steel, including zinc-treated steel, is subject to corrosion during storage and transportation. Corrosion can cause such steel to be sold at distressed prices and thus adversely affect steel mill economics. Corrosion-inhibiting formulations, commonly used to minimize such economic losses, utilize kerosene- or other oil-based solutions which make for very messy operating conditions. Moreover, such formulations are environmentally undesirable because of their hydrocarbon content; i.e. they are flammable and they contribute to both air and water pollution. In addition, it may be necessary to remove such corrosion inhibitors before final processing steps are carried out in the steel mill, thereby adding expense to the process. Known water-based formulations reduce or eliminate the water and air pollution and flammability concerns of, and can be more readily removed than, oil-based corrosion inhibitors. However, known water-based corrosion inhibitors typically do not provide enough corrosion protection, and they may contain environmentally undesirable zinc salts and metal chromates. Attempts have also been made to replace oil-based formulations used in stamping mills with dry coatings, however, dry coatings are not readily removed, thus making it difficult and expensive to paint or carry out other processing of steel surfaces.

BRIEF SUMMARY OF THE INVENTION

The present invention relates to compositions and processes which provide steel with protection against corrosion during fabrication, shipping and storage. The compositions and processes of this invention additionally provide enough lubricity during normal mill fabrication operations that one application thereof eliminates the need for application of various mill oils, for example those used for tempering operations (tempering is a process which involves subjecting long steel sheets to great pressure and stress via cold rolling using rolls running at differential rates of speed in excess of 1000 feet/minute). The compositions of this invention not only remain on the steel and perform as anti-corrosion and lubricating agents during routine treatments of steel, such as tempering and stamping, but will remain on the steel and function as an anti-corrosion agents during shipment to customers as well, thus eliminating the need for application of any shipping oil.

DETAILED DESCRIPTION OF THE INVENTION

The compositions of the present invention comprise a surfactant and a alkyl acid phosphate which, when applied together, provide superior corrosion protection on steel surfaces, including but not limited to mild steel and zinc-treated steel surfaces. Optionally, the composition additionally contains dodecenylsuccinic acid (DDSA), and/or one or more other carboxylic acids having both a hydrophilic end and a hydrophobic end. The compositions of this invention can be applied to steel with or without neutralization. For example, it can be advantageous to neutralize the compositions before applying them to zinc-coated steel. On the other hand, one can apply the compositions to mild steel without neutralization. In a preferred embodiment, the compositions of this invention are prepared and applied to steel surfaces as aqueous formulations.

The compositions of this invention provide superior corrosion protection under normal and humid storage conditions, when compared to that provided by any of the individual components of the composition. The compositions of the present invention shows other advantages, including absence of zinc or chromate salts commonly associated with anti-corrosion agents. The compositions also can be prepared and applied to steel in the absence of significant volatile organic solvents such as kerosene; they are non-flammable, and readily removable by a detergent wash before further processing, such as phosphate surface treatment and painting. The compositions of this invention are effective at low surface loading rates, compared with conventional coatings such as petroleum-based Ship Oils, thereby providing economic advantages during application and greatly reduced waste disposal when the protective coating must be washed off. A further aspect of this invention is an increase in lubricity for the surface, which reduces or eliminates the need for of any other lubricant for metal processing.

The surfactants useful for the present invention may be anionic, cationic, non-ionic, or mixtures thereof, preferably nonionic surfactants. Non-ionic surfactants preferably have HLB values between 3.5 and 13 ("The HLB System" published by ICI America's Inc., Wilmington, Del.). Examples of surfactants are given in, but not limited to, those disclosed in Table 1.

The alkyl phosphates useful for the purposes of this invention are those of the general formula:

$$(RO)_m—P—(O)—(OH)_n$$

wherein

R is an alkyl group having 4 to 20 carbon atoms;

m is 1 or 2, and n is 3−n.

One can also use mixtures of such alkyl phosphates. In an embodiment, one uses alkyl phosphates wherein R is 100% $C_{10}$. In a preferred embodiment, one uses a mixture of alkyl phosphates wherein R is a mixture of $C_8$ through $C_{16}$.

In one embodiment of the invention, the surfactant and alkylphosphate are mixed in water in a ratio by weight of from 10:1 to 1:10 (surfactant: alkylphosphate), preferably in a ratio of about 1.5:1 to 3:1, to form an aqueous emulsion. The surfactant and alkyl phosphate can be added to the water sequentially or simultaneously, at any concentration level which supports the formation of the emulsion in water. A single phase solution after mixing is indicative of the formation of the emulsion. The emulsion is adjusted with base to a pH of from 6 to 10, preferably from 6.5 to 8, and most preferably from 7 to 7.5. An alkali metal hydroxide, such as KOH, can be used, but any base which does not interfere with the formation or stability of the emulsion can be used, e.g. LiOH, NaOH, or ammonia. The emulsion can be diluted further with water to a final concentration for application to a metal surface. It is preferable to neutralize with an amine rather than an inorganic base. An amine can be added to the aqueous solution of the surfactant and alkyl phosphate. The amine may be a primary, secondary, or tertiary amine, chosen from alkylamines, alkanol amines, or aromatic alkyl amines. An amine containing a hydrophobic group appears to be the most effective. A preferred amine is N,N-dimethylcyclohexylamine. Examples of other amines are given in, but not limited to, Table 2. The aqueous emulsion comprising the neutralized alkyl phosphate, surfactant, and optionally the amine, provides effective corrosion protection to steel surfaces.

So as to achieve adequate corrosion inhibition, it is necessary at minimum to completely cover the surface of the steel with the compositions of this invention; any incompletely covered areas will corrode. The upper limit to the amount of the compositions applied to the steel surface is controlled by cost constraints and practical limits as to the amount of material that can be applied to the surface. There is a point after which additional material is not beneficial in further inhibiting corrosion. It is advantageous from a material and cost standpoint to coat the steel surface at the lowest level practical which provides corrosion protection under the conditions of interest (temperature and humidity). This can be readily determined by visual observation. Mixtures of surfactant and neutralized alkyl phosphate are effective in inhibiting corrosion on steel surfaces at application rates of from 1 mg/ft$^2$ to 1000 mg/ft$^2$.

In another embodiment of the present invention, dodecenylsuccinic acid (DDSA) is added to the mixture of surfactant and alkylphosphate, with or without neutralization, in a concentration of 5 to 40 percent by weight, relative to the combined amounts of surfactant and alkylphosphate. DDSA greatly improves the corrosion-preventing properties of the combination of the surfactant and alkylphosphate on zinc-treated steel under humid conditions.

In yet another embodiment of the present invention, another carboxylic acid is added to a mixture of the surfactant, alkyl phosphate, and DDSA in addition to, or in place of, DDSA. That additional carboxylic acid can be added with or without neutralizing said mixture. The carboxylic acid used in this embodiment is a long chain hydrocarbon acid with a hydrophilic and hydrophobic end, for example a fatty acid, a branched alkyl carboxylic acid, a dimer acid and mixtures thereof (hereinafter referred to as "hydrophilic-hydrophobic acids"); specific examples include oleic acid, lauric acid, stearic acid, sebacic acid, adipic acid, the $C_{18}$ unsaturated acids of the Examples, and the like. The hydrophilic-hydrophobic acid is added at a concentration of from 30% to 110% by weight based on the combined weight of surfactant and alkyl phosphate. The resulting composition can be neutralized with inorganic base or an amine and further diluted prior to application to the metal surface.

The addition of a combination of DDSA and a hydrophilic-hydrophobic acid to the mixture of surfactant and neutralized alkylphosphate provides the most effective corrosion protection for zinc-treated steel surfaces, particularly under high humidity conditions. That mixture is effective in inhibiting corrosion on zinc-coated steel surfaces at application rates of from 1 mg/ft$^2$ to 1000 mg/ft$^2$. Mixtures of the surfactant, DDSA, and fatty acids/amine without the alkyl phosphate give much lower corrosion protection.

Preferably, the compositions of this invention are prepared in water and applied to steel as an aqueous composition. Thus, for example, the use of an aqueous composition for application to steel is advantageous because the presence of water lowers the viscosity of the composition, making it easier to apply it to steel, also because the presence of water helps to control application rates. On the other hand, it is possible to prepare and apply the compositions neat (i.e. no solvent or other liquid medium). If prepared neat, these compositions optionally can be diluted with water for application to the metal surface.

The compositions of the present invention can be applied to the surfaces of manufactured steel, or galvanized steel sheet or stock, or the like, by dipping, spraying, or other appropriate methods and the steel dried by air jets or other appropriate method prior to conventional storage and transportation. The treated steel is well protected from ambient moisture, either as liquid water or as ambient humidity, during storage and transportation.

Depending on the subsequent processing, removal of the corrosion protection may be necessary, for instance prior to plating, painting, or surface coating. The corrosion inhibitors of this invention can be readily removed from the treated steel surfaces by washing with a solution of an appropriate alkaline surfactant in water.

The corrosion inhibiting compositions of this invention also impart enough lubricity to the metal surface that no additional surface treatment is necessary prior to other mill operations such as tempering or stamping.

The following Examples are given to further illustrate, but not limit the invention. Test methods used in connection with the Examples are given below.

CORROSION TESTING

1. Mild Steel—Coupons of 1020 mild steel were cleaned (detergent, deionized water, acetone), weighed, dip or spray treated, air or heat-gun dried, weighed again, then placed outdoors for 1 week in an exposed location. The coupons were then visually assessed for relative degrees of corrosion (evidenced by discoloration) in comparison to standards.

2. Galvanized Steel—Coupons of hot-dipped and annealed galvanized steel were cleaned (detergent, DI water, acetone), weighed, dip or spray treated, air or heat-gun dried, and weighed again. The coupons were then spotted with 0.5M copper (II) sulfate solution and observed visually for black corrosion formation within a specific amount of time. Untreated coupons generally corroded within 5 seconds, whereas exceptional coatings remained corrosion free for several minutes.

EXAMPLE 1

To a 2 liter flask containing 1296 grams of water at 40° C. were added 60 grams of an ethoxylated octanol phosphate ester nonionic surfactant with a HLB of 6.7, 24 grams of a mixed alcohol phosphate based on $C_8$, $C_{10}$, and $C_{12}$–$C_{16}$ alcohols in a ratio of 2.5:1.5:1, and 51 grams of ACINTOL® Fatty Acid 7002 (a mixture containing 83% dimer, trimer and higher molecular weight acids derived from the partial polymerization of those $C_{18}$ and $C_{20}$ fatty acids normally found in tall oil), 24 g of methanol, 5.8 g of xylene, 17.3 g of dodecenylsuccinic acid, and 22 g of dimethyl cyclohexylamine. The resulting mixture had a final pH of 7.4.

Zinc-coated steel coupons were dipped in the above compositions at ambient temperature and dried by evaporation in a laboratory hood. The resulting coupons were analyzed and determined to be coated with 1008 mg/ft$^2$ of the compositions. The coated coupon showed 12% corrosion in three minutes using 0.5M copper sulfate. Untreated coupons showed 100% corrosion in less than 5 seconds.

Control

Zinc-coated steel coupons (ACT A60 HDA 1"×4") treated with a formulation (530 mg/sq. ft.) based on Example 1 in which the alkyl phosphate was excluded showed 50% discoloration (corrosion) from 0.5M $CuSO_4$ solution in 30 seconds, and ca. 12% discoloration in 180 seconds at 1000 mg/sq. ft. for the phosphate-containing composition of Example 1.

EXAMPLE 2

To 1449 grams of water was added 15 grams of the nonionic surfactant used in Example 1, 6 grams of the mixed alkyl phosphate use in Example 1, and 12.8 g of ACINTOL® Fatty Acid 7002, 6 g of methanol, 1.5 g of xylene, 4.3 g of DDSA, and 5.5 g of N,N-dimethylcyclohexylamine. The final pH was 7.4.

The foregoing composition was applied to zinc- coated steel coupons so as to provide 50 mg/ft$^2$ of coating after application and evaporation to dryness. The treated coupons showed 100% corrosion in 70 seconds with 0.5M copper sulfate vs. 100% corrosion in <5 seconds for untreated coupons.

EXAMPLE 3

To a 2 liter resin flask having a water jacket for heating and cooling were added 1291 gm (8.16 moles) of a linear $C_{10}$ alcohol and 0.2 gm of phosphorous acid to reduce color formation. The flask was inerted with nitrogen and then 370 gm (2.61 moles) of phosphoric anhydride were added slowly with agitation over about 4 to 6 hours at 50°–600° C. After the end of the addition, the reaction mass was heated at 60°–700° C. for 12 hours to give about 1,661 gm of mixed decyl acid phosphates.

To 2592 grams of water at 40° C. were added 90 grams of a mixture of ethoxylated $C_{13}$ branched chain alkyl alcohols with a HLB of 12.8, 48 grams of mixed decyl phosphates (prepared by the method described above), 102 g of ACINTOL® Fatty Acid 7002, 48 g of methanol, 11.6 g of xylene, 34.6 g of DDSA and 44 g of N,N-dimethylcyclohexylamine, giving a final pH of 7.6.

The foregoing composition was applied to zinc-coated steel coupons so as to provide 432 mg/ft$^2$ of coating after application and drying. The resulting coupons showed no corrosion with 0.5M copper sulfate in three minutes vs. 100% corrosion in <5 seconds for untreated steel.

EXAMPLE 4

To 2592 grams of water at 40° C. were added 90 grams of a mixture of ethoxylated $C_{11}$–$C_{15}$ secondary alkyl alcohols with an HLB of 8, 48 grams of the mixed decyl phosphate of Example 3, 46 grams of methanol, 51 grams of oleic acid, 24 grams of dodecenylsuccinic acid, 8 grams of xylene, and 47 grams of dimethyl cyclohexylamine, resulting in a final pH of 7.4.

The foregoing composition was applied to zinc- coated steel coupons so as to provide 398 mg/ft$^2$ of coating after application and drying. The resulting coupons showed no corrosion in three minutes exposure to 0.5M $CuSO_4$ vs. 100% corrosion in <5 seconds for untreated steel.

EXAMPLE 5

Solution (A) To 440 grams of water were added 20 grams of the nonionic surfactant used in Example 1, 8 grams of the mixed alkyl phosphate used in Example 1, and 17 grams of ACINTOL® Fatty Acid 7002. To the resulting mixture were added 5.8 g of N,N-dimethylcyclohexylamine. The final pH was 7.3.

Solution (B) A control was prepared as above but 5.3 grams DDSA (75% in xylene) were added to the mixture.

Corrosion results: Zinc coated steel coupons treated with Solution (A), without the DDSA, showed 70% corrosion within 3 minutes after exposure to 0.5M $CuSO_4$. Coupons treated with the control, Solution (B), prepared with DDSA, showed 7% corrosion under the same conditions.

EXAMPLE 6

Example 1 was repeated except that the surfactants set forth in Table 1 were substituted for the nonionic surfactant of Example 1. ("Relative Corrosion Resistance" in Tables 1–3 is calculated by dividing the test time for a sample coated with a composition of this invention by the test time for an uncoated control, and dividing the resulting quantity by the amount of corrosion observed for the coated sample—e.g. coated sample showing 10% corrosion in 3 minutes v. control showing 100% corrosion in 0.5 minutes: [3/0.5]/0.1=60).

TABLE 1

| Product | Chemical | HLB | Coating Wt mg/ft 2 | Relative Corrosion Resistance |
|---|---|---|---|---|
| Control | no coating | | | 1 |
| NONIONIC | | | | |
| PLURONIC L92 | EO/PO BLOCK | 1.0 | 173 | 8 |
| SPAN 85 | SORBITAN TRIOLEATE | 1.8 | 437 | 7 |
| TRITON X-15 | OCTYLPHENOXY POLYETHOXY ETHANOL | 3.6 | 619 | >120 |
| SPAN 80 | SORBITAN MONOOLEATE NF | 4.3 | 578 | >120 |
| LIPICOL C2 | PEO(2) CETYLETHER | 5.3 | 578 | >120 |
| SURFACTANT OF EXAMPLE 1 | C8- > 20 PHOSPHATE ESTER EO ADDUCT | 6.7 | 492 | 80 |
| SURFACTANT OF EXAMPLE 4 | C11- > 15 SEC ALCOHOL ETHOXYLATE | 8.0 | 298 | >120 |
| TERGITOL N-P-4 | NONYL PHENOL ETHOXYLATE | 8.9 | 451 | >120 |
| SURFACTANT OF EXAMPLE 3 | ALCOHOL ETHOXYLATE | 10.5 | 490 | >120 |
| TERGITOL NP-7 | NONYL PHENOL ETHOXYLATE | 11.7 | 295 | 80 |
| SURFACTANTS | | | | |

TABLE 1-continued

| Product | Chemical | HLB | Coating Wt mg/ft 2 | Relative Corrosion Resistance |
|---|---|---|---|---|
| MERPOL SH | ALCOHOL ETHOXYLATE | 13.5 | 161 | 6 |
| IGEPAL CO-720 | NONYLPHENOL ETHOXYLATE | 14.2 | 139 | 7 |
| IGEPAL CO-970 | NONYLOPHENOL ETHOXYLATE | 18.2 | 254 | 6 |
| ANIONIC | | | | |
| BOISOFT D-40 | SODIUM DODECYLBENZENE SULFONATE | | 710 | 600 |
| DUPANOL C | SODIUM LAURYL SULFATE | | 245 | 8 |
| AEROSOL 22 | Tetra sodium N-(1,2-di-carboxyethyl)-N-octadecyl-sulfosuccinamate | | 101 | 7 |
| AEOROSOL OT | DIOCTYL ESTER OF SODIUM SULFOSUCCINIC ACID | | 1101 | >600 |
| CATIONIC | | | | |
| ARQUAD 16-50 | N-ALKYL TRIMETHYL AMMONIUM CHLORIDE | | 1017 | 10 |

Notes: Tests were conducted with 0.5M $CuSO_4$. Corrosion numbers were determined relative to the control. Where solutions were two-phased, they were mixed immediately prior to application.

EXAMPLE 7

Into 415 ml of water were added 20 grams of the nonionic surfactant of Example 1, followed by 8 grams of the alkyl phosphate of Example 1, 16 grams of ACINTOL® Fatty Acid 7002, 3 grams of dodecenylsuccinic acid containing 1 gram of xylene, 10 grams of methanol, and the following amounts of amine. (weights changed to reflect different molecular weights~same equivalents)

TABLE 2

| Amine | weight, g | Emulsion pH | Coating Wt mg/ft 2 | Relative Corrosion Resistance |
|---|---|---|---|---|
| Dimethylcyclohexyl-amine | 10.0 | 7.3 | 1032 | 15 |
| Triethylamine | 7.9 | 7.7 | 463 | 6 |
| Tributylamine | 14.6 | 7.3 | LOW | <6 |
| N,N-Dimethylbenzyl amine | 10.6 | 7.4 | 1154 | >120 |
| Diethylamine | 5.7 | 6.4 | 305 | 48 |
| Dibutylamine | 10.2 | 6.8 | LOW | <6 |
| Dibenzylamine | 15.5 | 6.6 | 514 | 6 |
| Phenethylamine | 9.5 | 7.2 | 341 | 7 |
| Triethanolamine | 11.7 | 7.4 | 564 | 120 |
| Diethanolamine | 8.3 | 7.4 | 540 | 30 |
| "Texlin" *300 | 4.0 | 7.4 | LOW | >600 |
| Control | | No coating | | 1 |

Tributyl, dibutyl, octyl, and phenethyl amines resulted in two phase systems that were mixed to allow application. Tests were conducted with 0.5 M $CuSO_4$.

*trademark of Texaco for a mixture of triethylene tetramine, tris(aminoethyl) amine, piperizinylethyl-ethylenediamine, and N,N'-bis)2-aminoethyl) piperazine.

EXAMPLE 8

To 432 grams of water at 40° C. were added 20 grams of the surfactant of Example 1 and 8 grams of the alkyl phosphate of Example 1. The temperature was raised to 80° C. after which 17 grams of the acids of Table 3 were added. The temperature was lowered to 40° C. after which 7.7 grams of methanol and 5.3 grams of dodecenyl succinic acid (75% in xylene) were added. The pH was then adjusted to 7.4 with dimethylcyclohexylamine. Zinc-coated steel coupons were dipped into the compositions and dried. Corrosion inhibition was tested with 0.5M $CuSO_4$.

TABLE 3

| Acid | Relative Corrosion Resistance |
|---|---|
| no coating | 1 |
| polymerized $C_{18}$—$C_{20}$ fatty acid mixture of Example 1 | 24 |
| Lauric acid | 14 |
| Oleic Acid | 86 |
| Stearic Acid | 13 |

Comments: The 80° C. temperature was to melt the solid acids, lauric and stearic; the $C_{18}$–$C_{20}$ mixed acid is a liquid.

EXAMPLE 9

The lubricity enhancing effects achieved by treating surfaces with compositions of this invention were demonstrated by measuring the static friction of metal coupons that were treated with the aqueous product of Example 1 and Example 2. The two solutions were prepared and applied to virgin galvanized strip steel (0.030 Hot Dipped Annealed) via spray techniques. Uniform 2"×4" metal coupons were cut from the treated strip and analyzed for coating pick-up via difference by weight. Representative samples from each dilution were then analyzed for static friction values by ASTM Method D 4518-91, Test Method A, using an inclined plane. Two treated coupons were placed face to face on a level plane, and a 500 gram weight was placed on the coupons to produce a force of 62.5 gm per square inch of surface, and the inclination of the plane was increased at a rate of 14 degrees per minute. The static friction value was determined as the Tangent of the angle at which the two coupons just began to slide over one another. Triplicate values were determined for each pair of slides for each treatment.

| Example | Coating Wt. | Avg. Angle of Slide | Static Friction |
|---|---|---|---|
| Control | 0 mg/sq. ft. | 28.2 | 0.54 |
| Product of Example 2 | 15 mg/sq. ft | 23.0 | 0.42 |
| Product of Example 1 | 50 mg/sq. ft. | 15.7 | 0.28 |

EXAMPLE 10

Into 432 ml of water were added 8.0 grams of the nonionic surfactant of Example 1, followed by 20.0 grams of the alkyl phosphate of Example 1 giving a final pH of 2.0.

The foregoing composition was applied to zinc-coated steel coupons so as to provide 250 mg/ft$^2$ of coating after application and drying. The resulting coupons showed 100% corrosion with 0.5M copper sulfate in 80 seconds vs. 100% corrosion in <5 seconds for untreated steel. In addition, the foregoing composition was applied to 1020 mild steel coupons so as to provide 250 mg/ft$^2$ of coating after application and drying. The resulting coupons showed <5% flash (red) rust after 2 weeks in an outdoor, exposed area (50°–90° F., 30–100% humidity) compared with 100% with untreated steel.

EXAMPLE 11

Into 432 ml of water were added 8.0 grams of the nonionic surfactant of Example 1, followed by 20.0 grams of the alkyl phosphate of Example 1 and 11.8 grams of 50% potassium hydroxide giving a final pH of 7.50.

The foregoing composition was applied to zinc-coated steel coupons so as to provide 200 mg/ft$^2$ of coating after application and drying. The resulting coupons showed 80% corrosion with 0.5M copper sulfate in 180 seconds vs. 100% corrosion in <5 seconds for untreated steel. In addition, the foregoing composition was applied to 1020 mild steel coupons so as to provide 200 mg/ft$^2$ of coating after application and drying. The resulting coupons showed 5–10% flash (red) rust after 2 weeks in an outdoor, exposed area (50°–90° F., 30–100% humidity) compared with 100% with untreated steel.

EXAMPLE 12

Into 432 ml of water were added 20.0 grams of the nonionic surfactant of Example 1, followed by 8.0 grams of the alkyl phosphate of Example 1, 17.0 grams of ACINTOL® Fatty Acid 7002, 7.7 grams of methanol, 5.3 grams of DDSA, and 7.50 grams of 100% ammonium hydroxide giving a final pH of 7.50.

The foregoing composition was applied to zinc-coated steel coupons so as to provide 575 mg/ft$^2$ of coating after application and drying. The resulting coupons showed 5% discoloration with 0.5M copper sulfate in 180 seconds vs. 100% discoloration in <5 seconds for untreated steel.

What is claimed is:

1. An aqueous or neat composition consisting essentially of the following three components, (a) a surfactant other than alkyl acid phosphate; and (b) at least one alkyl acid phosphate, in a surfactant:phosphate weight ratio in the range between 10:1 to 1:10, said phosphate having the general formula:

$$(RO)_m—P—(O)—(OH)_n$$

wherein

R is an alkyl group having 4 to 20 carbon atoms;

m is 1 or 2, and n is 3–m, and (c) an amine.

2. The composition of claim 1 wherein R is an alkyl group containing 10 carbon atoms.

3. The composition of claim 1 wherein R is a mixture of alkyl groups containing 8 to 16 carbon atoms.

4. The composition of claim 1 wherein said ratio is in the range between 1:3 and 1:1.5.

5. The composition of claim 1 wherein said amine is N,N-dimethycyclohexylamine.

6. A composition of claim 1 further comprising 5 to 40 weight percent, based on the combined weight of said surfactant and said phosphate, of at least one carboxylic acid which has both a hydrophilic and a hydrophobic portion.

7. The composition of claim 6 in which at least one of said acids is dodecenylsuccinic acid.

8. The composition of claim 7 further characterized in that it additionally contains at least one other carboxylic acid which has both a hydrophilic and a hydrophobic portion.

9. A process for imparting corrosion resistance and lubricity to steel which comprises applying to the steel surface an aqueous or neat composition consisting essentially of the following two components, (a) a surfactant other than alkyl acid phosphate; and (b) at least one alkyl acid phosphate, in a surfactant:phosphate weight ratio in the range between 10:1 to 1:10, said phosphate having the general formula:

$$(RO)_m—P—(O)—(OH)_n$$

wherein

R is an alkyl group having 4 to 20 carbon atoms;

m is 1 or 2, and n is 3–m.

10. The process of claim 9 wherein R is an alkyl group containing 10 carbon atoms.

11. The process of claim 9 wherein R is a mixture of 8 to 16 carbon atoms.

12. The process of claim 9 wherein said ratio is in the range between 1:3 and 1:1.5.

13. The process of claim 9 wherein said phosphate is amine-neutralized.

14. The process of claim 13 wherein said phosphate is neutralized by N,N-dimethylcyclohexylamine.

15. The process of claim 9 in which at least one of said acids is dodecenylsuccinic acid.

16. The process of claim 15 further characterized in that said composition additionally contains at least one other carboxylic acid which has both a hydrophilic and a hydrophobic portion.

17. A process of claim 9 wherein said composition further comprises 5 to 40 weight percent, based on the combined weight of said surfactant and said phosphate, of at least one carboxylic acid which has both a hydrophilic and a hydrophobic portion.

18. The process of claim 17 wherein said phosphate is amine neutralized.

19. A composition consisting essentially of the following three components, (a) a surfactant other than alkyl acid phosphate;

(b) at least one alkyl acid phosphate in a surfactant:phosphate weight ratio in the range between 10:1 to 1:10, said phosphate having the general formula $$(RO)_m—P—(O)—(OH)_n$$

wherein

R is an alkyl group having 4 to 20 carbon atoms;

m is 1 or 2, and n is 3−m, and (c) from about 5 to 40 weight percent, based upon the combined weight of said surfactant and said phosphate, of at least one carboxylic acid which has both a hydrophilic and a hydrophobic portion.

20. The composition of claim 19 wherein said phosphate is amine neutralized.

* * * * *

UNITED STATES PATENT AND TRADEMARK OFFICE

CERTIFICATE OF CORRECTION

PATENT NO. : 5,650,097

DATED : July 22, 1997

INVENTOR(S) : Ernest Byron Wysong, James Allan Wingrave, Steven Arnold Dombchik, Edward Clarkin Squire It is certified that error appears in the above-identified patent and that said Letters Patent is hereby corrected as shown below:

In the Abstract, second paragraph, line 8, "3m" should read -- 3 - m --

In column 2, line 45, "3-n" should read: -- 3 - m --.

Signed and Sealed this

Eleventh Day of November, 1997

*Attest:*

Bruce Lehman

BRUCE LEHMAN

*Attesting Officer*

*Commissioner of Patents and Trademarks*